US005174199A

United States Patent [19]

King et al.

[11] Patent Number: 5,174,199

[45] Date of Patent: Dec. 29, 1992

[54] APPARATUS FOR CRUSHING ARTICLES SUCH AS OIL FILTERS OR THE LIKE

[75] Inventors: David A. King, Oconomowoc; Kenneth R. Hepp, Hartland, both of Wis.

[73] Assignee: Gardner Barn Equipment Co., Inc., Milwaukee, Wis.

[21] Appl. No.: 676,876

[22] Filed: Mar. 28, 1991

[51] Int. Cl.[5] ..... B30B 15/16; B30B 9/32

[52] U.S. Cl. ..... 100/48; 100/53; 100/253; 100/256; 100/266; 100/269 R; 100/902

[58] Field of Search ..... 100/43, 48, 53, 253, 100/256, 268, 269 R, 902, 266

[56] References Cited

U.S. PATENT DOCUMENTS

| | | | |
|---|---|---|---|
| 2,800,159 | 7/1957 | Walsh et al. | 100/53 |
| 2,813,569 | 11/1957 | Nelson | 100/256 X |
| 2,904,097 | 9/1959 | Cohen | 100/53 |
| 3,024,720 | 3/1962 | Welsh | 100/902 X |
| 3,104,607 | 9/1963 | Galas | 100/902 X |
| 3,352,230 | 11/1967 | Hunnicutt | 100/902 X |
| 4,005,648 | 2/1977 | Edwards | 100/53 |
| 4,430,934 | 2/1984 | Goldhammer | 100/53 |
| 4,570,536 | 2/1986 | Dodd | 100/256 X |
| 5,060,564 | 10/1991 | Buford et al. | 100/53 X |

*Primary Examiner*—James E. Bryant, III
*Assistant Examiner*—Stephen F. Gerrity
*Attorney, Agent, or Firm*—Andrus, Sceales, Starke & Sawall

[57] ABSTRACT

An oil filter crusher includes a housing within which a piston assembly is mounted for reciprocating movement. The crusher is connectable to an external source of pressurized air, and an air valve is located in the interior of the housing for controlling supply of pressurized air to the piston assembly. A door is mounted to the housing for movement between open and closed positions. An actuator arrangement is provided between the door and the air valve, for actuating the air valve upon closing of the door to initiate a crushing stroke of the piston assembly. A locking arrangement is provided between the piston assembly and the door, to prevent the door from being moved to its open position during the crushing stroke of the piston assembly. A shut-off arrangement provided on the piston assembly causes movement of the door away from its closed position during completion of the crushing stroke of the piston assembly, to cause the actuator arrangement to cut off pressurized air supply through the air valve to the piston head. Springs mounted to the piston assembly then return the piston assembly to an upper position in preparation for a subsequent crushing operation.

15 Claims, 3 Drawing Sheets

FIG. 3
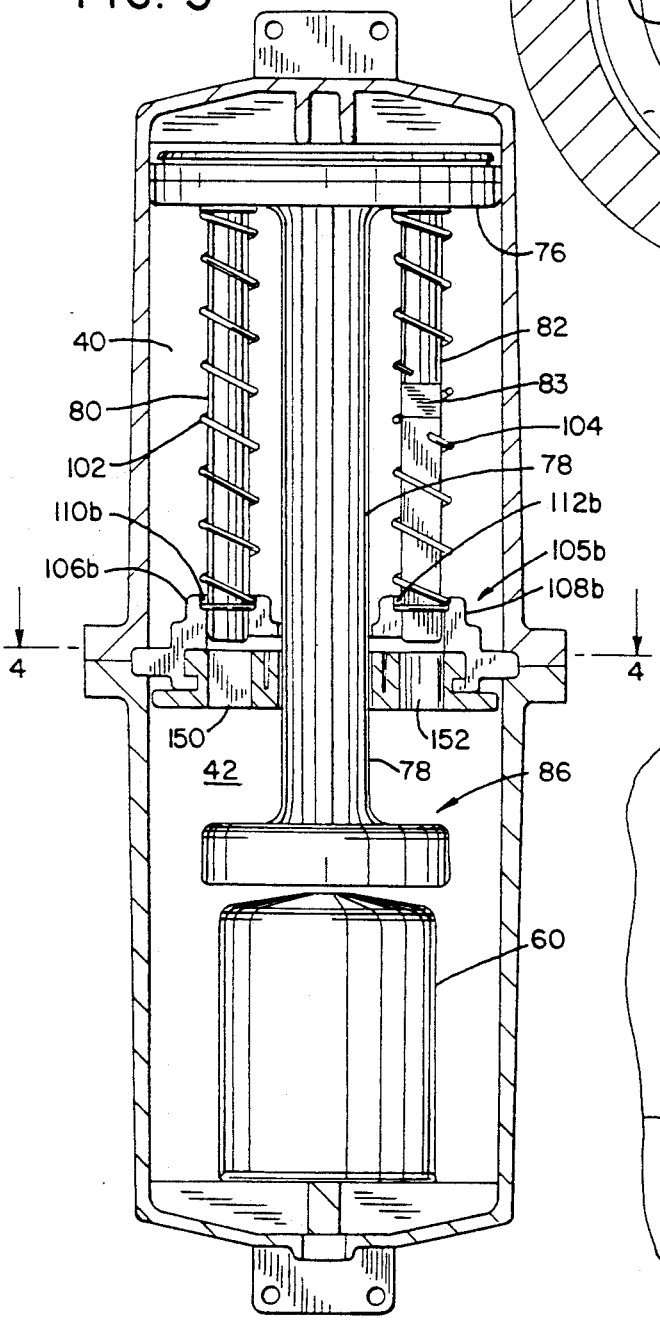
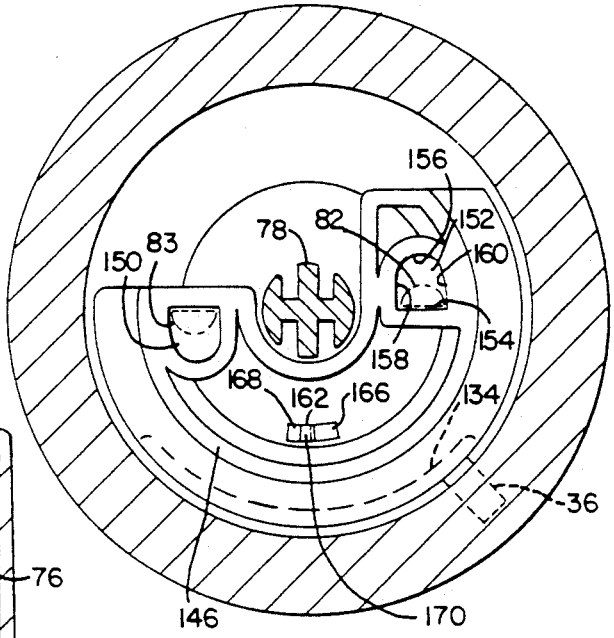
FIG. 4
FIG. 5
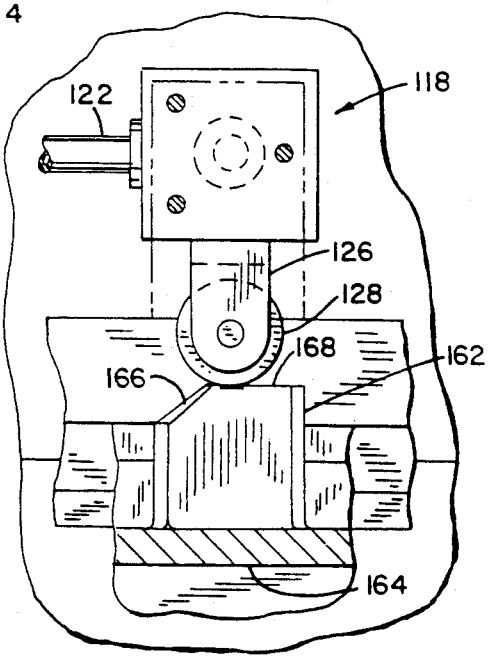

FIG. 6
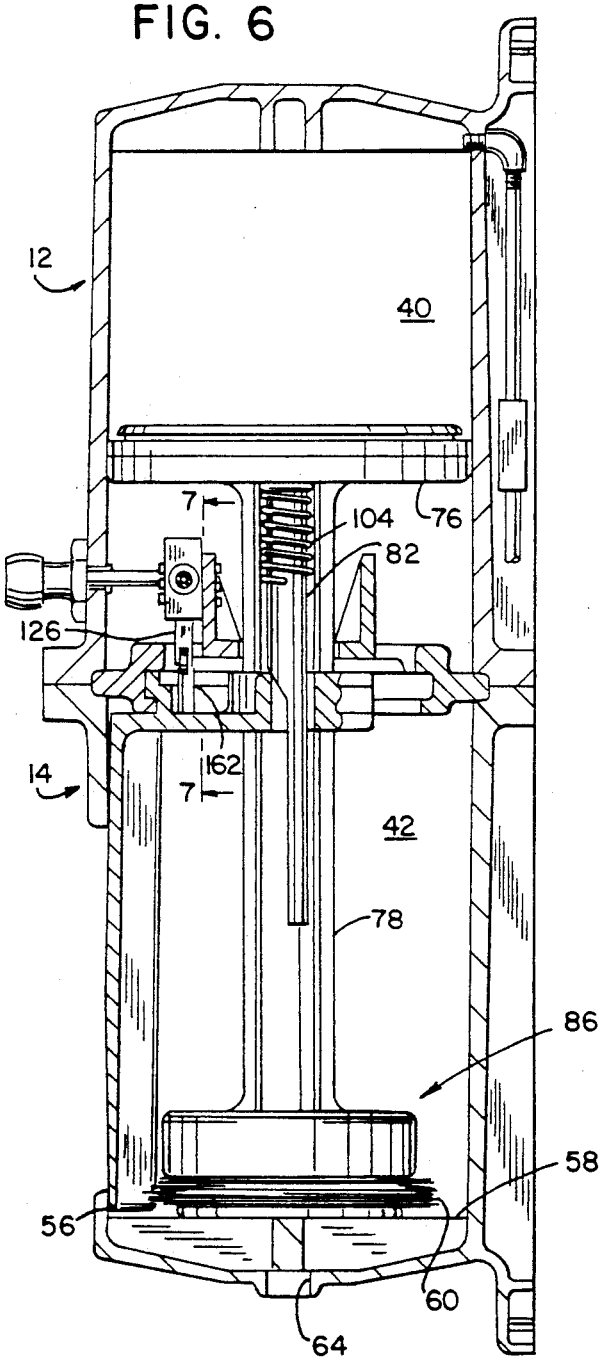
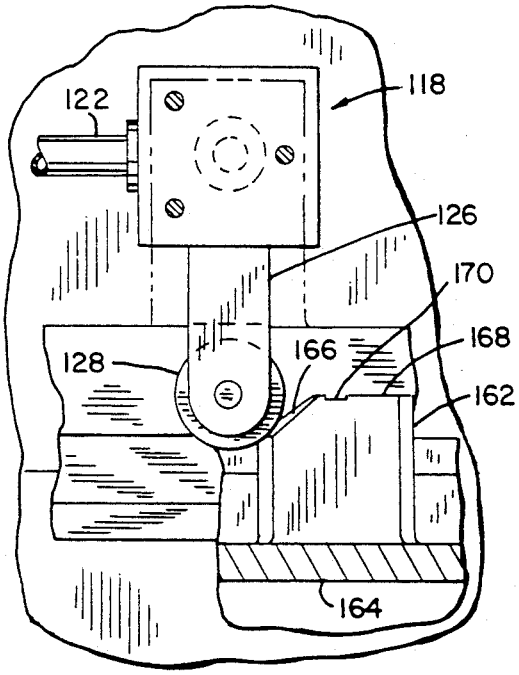
FIG. 7

APPARATUS FOR CRUSHING ARTICLES SUCH AS OIL FILTERS OR THE LIKE

BACKGROUND OF THE INVENTION

This invention relates to a device for crushing an article such as an oil filter, and more particularly to such a device which includes a piston assembly operating under the influence of pressurized fluid to crush the article.

Disposal of used oil filters presents several problems. For one, a used oil filter contains a volume of waste oil which, if the filter is discarded into a landfill or the like, presents the possibility of introducing a toxic and flammable material into the landfill. In addition, an oil filter essentially consists of a metal shell having a high volume of empty space in its interior, which occupies a larger volume than necessary when discarded.

The problems noted above are made especially acute in an operation which generates a large number of used oil filters, such as automotive service stations, oil change centers, or vehicle fleet maintenance centers.

The present invention has its object to provide an oil filter crusher which simultaneously compacts a used oil filter and expels used oil from the filter. A further object of the invention is to provide an oil filter crusher which is simple in construction and operation, yet which incorporates a number of features which enhance the safety and operation of the crusher.

The invention contemplates an oil filter crusher having a housing defining an internal cavity including a crushing chamber adapted to receive an oil filter. The housing includes an opening which provides access to the crushing chamber. A door is movably mounted to the housing at the opening. The door is movable between an open position for providing access to the crushing chamber to allow placement of an oil filter in the crushing chamber or removal of an oil filter therefrom, and a closed position to block access to the crushing chamber through the opening. A reciprocable member is located within the cavity. Movement of the reciprocable member in a first direction provides a crushing stroke for compacting the oil filter and expelling used oil therefrom. Movement of the reciprocable member in a second direction provides a return stroke. The reciprocable member preferably comprises a piston assembly having a head and a rod. Structure is provided at the end of the rod opposite the head for engaging the oil filter during the crushing stroke. A selectively actuable pressurized fluid supply system is provided for supplying pressurized fluid to the piston head to move the piston in the first direction to provide the crushing stroke. The pressurized fluid is provided to a piston chamber forming part of the internal cavity of the housing, and the piston head is movable in the first direction in response to supply of pressurized fluid to the piston chamber. The pressurized fluid is preferably compressed air, supplied from an external air compressor through a fitting to the pressurized fluid supply system. A selectively actuable valve is provided in the pressurized fluid supply system, for selectively supplying pressurized air to the piston chamber, and selectively cutting off supply of pressurized air to the piston chamber.

In accordance with one aspect of the invention, an actuator arrangement is interposed between the door and the pressurized fluid supply system, for actuating the system upon movement of the door to its closed position to automatically supply pressurized fluid to the piston chamber. In this manner, the crushing stroke of the piston assembly is initiated upon closing of the door. The valve is preferably located in the internal cavity defined by the housing, and includes a movable stem for controlling the flow of pressurized fluid therethrough. An actuator member is mounted to the door for engaging the movable valve stem upon movement of the door to its closed position. A plate member is located within the housing cavity, and the door is mounted to the plate member for movement between its open and closed positions. The door is provided with a horizontal portion which is movably mounted to the plate member for supporting the door and providing movement thereof, and a vertical portion for enclosing the opening in the housing when the door is in its closed position. The actuator member is mounted to the horizontal portion of the door, and movement of the door to its closed position causes the actuator member to engage the valve stem to supply pressurized fluid to the piston head chamber. Movement of the door away from its closed position disengages the actuator member for the valve stem, to cut off the supply of pressurized fluid to the piston chamber and to allow the return stroke of the piston assembly.

In accordance with another aspect of the invention, a locking arrangement is provided for preventing movement of the door to its open position during the crushing stroke of the piston assembly. The locking arrangement consists of locking structure associated with the piston assembly, which is engageable with locking structure associated with the door during movement of the piston assembly in the first direction during its crushing stroke. As noted previously, the door includes a transverse, or horizontal, portion disposed within the housing cavity, and the locking structure associated with the door includes one or more passages through the transverse portion of the door. The locking structure associated with the piston assembly consists of one or more guide rods mounted to the piston assembly which extend into and through the one or more passages in the transverse portion of the door during movement of the piston assembly in the first direction. With this arrangement, engagement of the guide rods within the passages in the transverse portion of the door prevents the door from being moved to its open position during the crushing stroke of the piston assembly.

In accordance with another aspect of the invention, a shut-off arrangement is interposed between the pressurized fluid supply system and the piston assembly, for cutting off the supply of pressurized fluid to the piston assembly upon attainment of a predetermined position of the piston assembly within the cavity, to terminate the crushing stroke of the piston assembly. As summarized above, an actuator arrangement is interposed between the door and the pressurized fluid system for actuating the pressurized fluid system upon movement of the door to its closed position, and takes the form of an actuator member mounted to a horizontal portion of the door. The actuator member engages a movable valve stem provided on a valve associated with the pressurized fluid supply system to control passage of pressurized fluid to the piston chamber. The shut-off arrangement includes a ramped surface provided on the piston assembly for moving the door away from its closed position upon attainment of a predetermined position of the piston assembly during its movement in the first direction. Such movement of the door away from its closed position results in disengagement of the actuator member and the movable valve stem, so that the supply of pressurized fluid through the valve to the piston chamber is cut off. When this occurs, the crushing stroke of the piston member is terminated. The ramped surface is provided on one or more of the guide rods which are mounted to the piston head, and engage a surface provided on the transverse, or horizontal, portion of the door for moving the door away from its closed position. As noted previously, the guide rods extend into and through passages formed in the transverse portion of the door to prevent the door from being opened during the crushing stroke of the piston assembly.

In a particularly preferred embodiment of the invention, the various aspects and features as summarized above are combined into a single structure for providing simplicity in construction and safety in operation of an oil filter crusher.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a longitudinal section view taken along line 3—3 of FIG. 2;

FIG. 4 is a transverse section view taken along line 4—4 of FIG. 3;

FIG. 5 is a partial section view taken along line 5—5 of FIG. 2;

FIG. 6 is a view similar to FIG. 2, showing the position of the piston assembly upon completion of a downward crushing stroke; and FIG. 7 is a partial section view taken along line 7—7 of FIG. 6.

DETAILED DESCRIPTION OF THE PREFERRED EMBODIMENT

Figure 1:
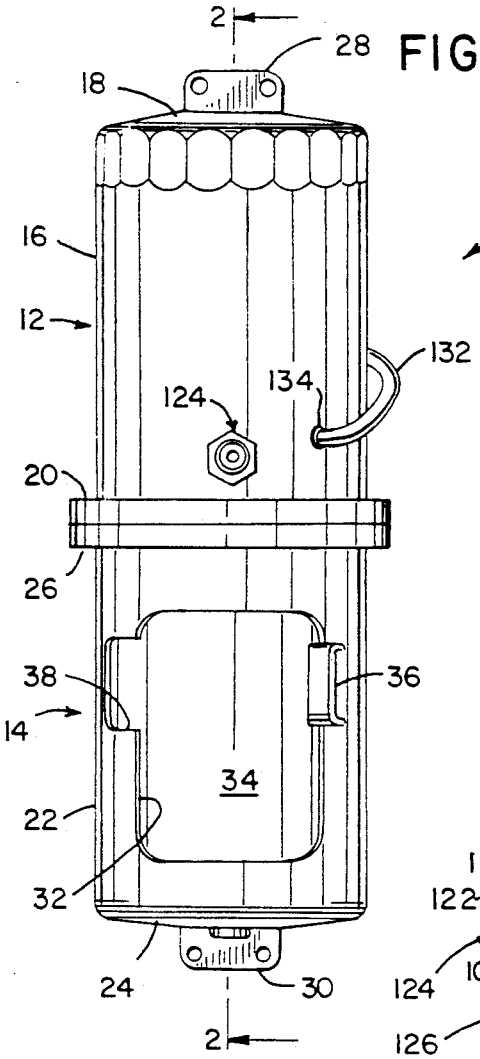
FIG. 1 is a front elevation view of an oil filter crusher constructed according to the invention.

Referring to FIG. 1, an oil filter crusher 10 constructed according to the invention includes an upper shell 12 and a lower shell 14. Upper shell 12 comprises a cylindrical member providing a side wall 16 and an upper wall 18, with a flange 20 provided at the lower end of side wall 16. In a similar manner, lower shell 14 comprises a side wall 22 and an end wall 24, with a flange 26 provided at the upper end of side wall 22. Flange 20 of upper shell 12 and flange 26 of lower shell 22 are adapted to face each other and to be secured together in any satisfactory manner, such as by means of bolts extending through aligned through-holes formed in flanges 20 and 26, so as to assemble upper shell 12 and lower shell 14 together to form a unitary housing.

An upper mounting flange 28 is provided on upper shell 12, and a lower mounting flange 30 is provided on lower shell 14. Mounting flanges 28, 30 are provided with openings therethrough to accommodate mounting of crusher 10 to a wall by means of threaded fasteners or the like.

A substantially rectangular opening 32 is formed in side wall 22 of lower shell 14. A door 34 is interconnected with lower shell 14 in a manner to be explained, for selectively enclosing the passage formed by opening 32. Door 34 includes a handle 36, and opening 32 is provided with a recessed portion 38 for accommodating handle 36 when door 34 is moved to its open position.

Figure 2:
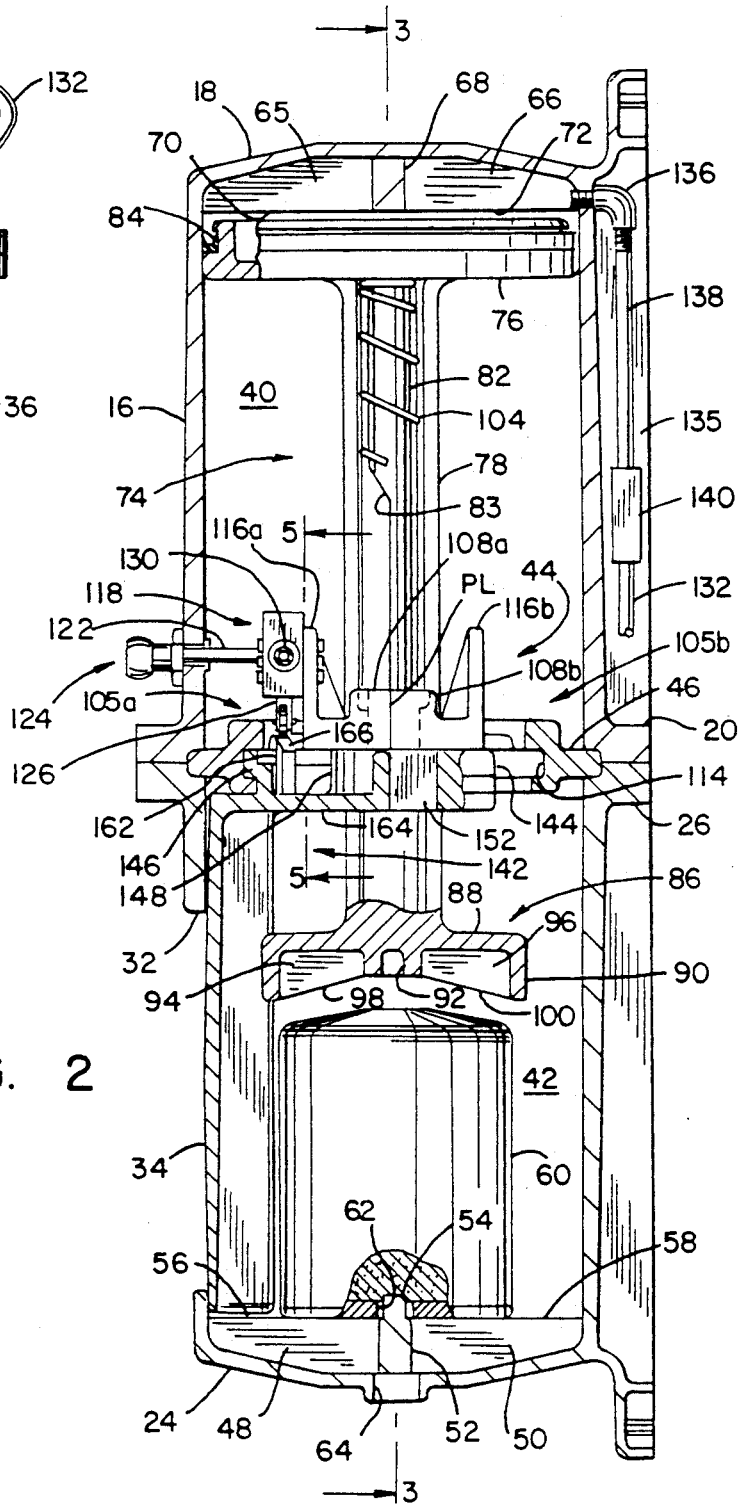
FIG. 2 is a longitudinal section view taken along line 2—2 of FIG. 1.

Referring to FIG. 2, and as mentioned previously, upper shell 12 and lower shell 14 cooperate to define an internal cavity, which consists of an upper piston chamber 40 and a lower crushing chamber 42. A center plate assembly consisting of two semicircular plate halves and which is shown generally at 44, separates piston chamber 40 from crushing chamber 42. Center plate assembly 44 includes an outer annular flange 46 which is sandwiched between flanges 20, 26 of upper shell 12 and lower shell 14, respectively, to secure center plate assembly 44 in position within the interior of the housing defined by upper shell 12 and lower shell 14. The details of center plate assembly 44 will later be explained.

Referring to FIG. 2, the lower interior portion of lower shell 14 includes a series of eight equally radially spaced ribs, two of which are shown at 48 and 50, each of which is connected at its inner end to a central hub 52. The ribs such as 48, 50, and hub 52 are formed integrally with lower shell 14 in an injection molding process. Hub 52 is provided with a reduced diameter stud 54 extending upwardly from its upper end and above the upper rib surfaces, such as shown at 56, 58. An oil filter, such as shown at 60, is adapted to be placed within crushing chamber 42 such that its lower surface engages and is supported by the rib upper surfaces, such as 56, 58, with the mounting opening, shown at 62, of oil filter 60 being placed over stud 54 to properly locate oil filter 60 within crushing chamber 42.

An opening 64 is formed in end wall 24 of lower shell 14, below hub 52. Opening 64 communicates with the open areas between the radial ribs, such as 48, 50.

As also shown in FIG. 2, the upper portion of piston chamber 40 defined by upper shell 12 is provided with a series of eight radial ribs, such as shown at 65, 66, which are connected at their inner ends to a hub 68. The ribs, such as 64, 66, are formed integrally with upper shell 12 in an injection molding process, and extend into the interior of upper shell 12 from its end wall 18. Each of the ribs defines a lower surface, such as shown at 70, 72.

As noted, upper and lower shells 12, 14 are formed of a thermoplastic material in an injection molding process. A talc-filled polypropylene material, consisting of approximately 40% talc, is employed to form upper and lower shells 12, 14.

A piston assembly, shown generally at 74, is mounted for reciprocating movement within the internal cavity defined by upper and lower shells 12, 14 when joined together. Referring to FIGS. 2 and 3, piston assembly 74 includes a piston head 76 located within piston chamber 40, and a depending piston rod 78. A pair of guide rods 80, 82 are formed integrally with piston assembly 74, and extend downwardly from the lower surface of piston head 76 parallel to piston rod 78 and spaced 180° apart from each other.

Guide rods 80, 82 are substantially circular in cross-section immediately below the lower surface of piston head 76. Referring to guide rod 82 in FIGS. 2 and 3, a ramped surface 83 is provided below the circular upper portion of the guide rod 82, and the portion of guide rod 82 below ramped surface 83 is semicircular in cross-section. Guide rod 80 is formed similarly to guide rod 82.

In accordance with known piston/cylinder construction, the outer circumferential surface of piston head 76 is located closely adjacent the inner surface of upper shell side wall 16. A circumferential U-shaped seal 84 (FIG. 2) is mounted within a groove formed in the outer circumferential surface of piston head 76, and provides an air-tight seal between piston head 76 and the inner surface of upper shell side wall 16.

An inverted cup-shaped filter engaging member 86 is provided at the lower end of piston rod 78, and is formed integrally therewith. Filter engaging member 86 consists of an upper horizontal wall 88 and annular outer side wall 90, an annular inner wall 92, and a series of eight radially spaced ribs, such as 94, 96, extending between outer wall 90 and inner wall 92. The ribs define lower surfaces, such as shown at 98, 100 which slope upwardly between outer wall 90 and inner wall 92, so as to provide a cross-section roughly corresponding to the cross-sectional shape of the upper surface of oil filter 60.

Piston assembly 74 is a one-piece injection molded member formed of any satisfactory high-strength thermoplastic material.

Referring to FIG. 3, guide rods 80, 82 of piston assembly 74 extend through a pair of springs, 102, 104, respectively, which bear between the lower surface of piston head 76 and center plate 44. Springs 102, 104 act to bias piston head 76 upwardly within piston chamber 40.

Referring to FIG. 2, center plate assembly 44 consists of a pair of identical semicircular plate sections, shown generally at 105*a*, 105*b*. Plate sections 105*a*, 105*b* are assembled about piston rod 78, with each section including an opening for accommodated piston rod 78. A parting line, shown in FIG. 2 at PL, separates the facing surfaces of sections 105*a*, 105*b*.

Referring to FIG. 3, plate section 105*b* is provided with a pair of bosses 106*b*, 108*b*. Similarly, plate section 105*a* is provided with a pair of bosses, one of which is shown in FIG. 2 at 108*a*. The bosses each including facing grooves which cooperate to define circular vertical passages which receive guide rods 80, 82 therein during the crushing stroke of piston assembly 74. The bosses further include recessed areas, such as shown at 110*b*, 112*b* in FIG. 3, which receive the lower ends of springs 102 and 104 when plate sections 105*a*, 105*b* are assembled together.

As shown in FIG. 2, center plate assembly 44 further includes an annular channel 114 within which an assembly containing door 34 is mounted, in a manner to be explained.

Center plate assembly 44 is also provided with a pair of upstanding mounting brackets 116*a*, 116*b*, which provide a flat vertical mounting surface. An air valve 118 is mounted to bracket 116*a* by means of a series of threaded fasteners, such as shown at 120, which extend through mounting bracket 116*a*.

An air conduit 122 is connected between air valve 118 and side wall 16 of upper shell 12. The male portion of a quick-connect pneumatic coupling, shown at 124, is connected to conduit 122 and secured to upper shell side wall 16. Male portion 124 is adapted to receive the female portion of the quick-connect pneumatic coupling, in a manner as is known, so as to supply pressurized air therethrough from a source of pressurized air (not shown), such a conventional air compressor. In this manner, pressurized air is supplied to air valve 118 through conduit 122.

Air valve 118 is a conventional two-way four-position pneumatic valve, such as is available from Schrader Bellows of P.0. Box 631, Akron, Ohio 44309, under its Model No. 52421-1000. Air valve 118 is provided with a movable valve stem 126 (FIGS. 2, 5), biased downwardly, with a roller 128 rotatably mounted at the lower end of valve stem 126.

Air valve 118 includes an outlet nipple 130 (FIG. 2), and a flexible air hose 132 (FIG. 1) is connected to output nipple 130. As shown in FIG. 1, hose 132 extends from nipple 130 through a fitting 134 mounted to upper shell side wall 16, and wraps around to the back of upper shell 12, where it is disposed within a vertical channel 135 associated with upper shell 12.

As shown in FIG. 2, an elbow fitting 136 is connected to upper shell side wall 16 between two of the upper ribs, such as 64, 66, and provides communication through a conduit 138 and a pressure relief valve 140 with hose 132, to define a flow path extending between the upper end of upper shell 12 and air valve 118.

As noted previously, a door assembly, shown at 142 (FIG. 2), includes a vertical arcuate door 34 to which a handle 36 is connected. Door assembly 142 further includes an upper transverse, or horizontal, slide portion 144, which extends into the internal cavity defined by upper and lower shells 12, 14. Slide portion 144 includes a curved slide element 146 which is received within groove 114 of center plate assembly 44, and which is movable therein to provide revolving opening and closing of door 34 about an axis defined by piston rod 78. Slide portion 144 further includes an upstanding inner wall 148, which is located closely adjacent the outer surface of piston rod 78 so as to maintain slide element 146 in engagement within channel 114.

Referring to FIGS. 2–4, slide portion 144 of door assembly 142 further includes a pair of passages 150, 152, defined by upstanding walls extending upwardly from the lower surface of slide member 144. Referring to FIG. 4, passage 152 is defined by a flat surface 154, a curved surface 156 spaced from flat surface 154, and a pair of arcuate surface 158, 160 extending between surfaces 154 and 156. Passage 150 is shaped similarly to passage 152.

Referring to FIGS. 2 and 4, slide portion 144 of door assembly 142 further includes an actuator member 162 extending upwardly from the lower wall of slide portion 144, shown at 164. Actuator member 162 extends substantially vertically, and includes a ramped surface 166 leading to an upper actuator surface 168. A depression 170 is provided in actuator surface 168.

Having described the structural features of the various components of oil filter crusher 10, the interrelationship of such structural features and the functioning of oil filter crusher 10 will now be explained.

In operation, with reference to FIG. 1, a person first connects the female end of a pressurized air hose quick connect coupling to male portion 124, to supply pressurized air to air valve 118. The user then gains access to crushing chamber 42 by grasping door handle 36 and moving door 34 in a right-to-left direction until handle 36 is engaged within recess 38 of opening 32 formed in lower shell side wall 22. Such movement of door 34 is provided by movement of slide element 146 of door slide portion 144 within channel 114 of center plate assembly 44. When door 34 is moved to its open position as described, the user places an oil filter, such as 60, within crushing chamber 42, such that stud 54 is engaged within the lower opening 62 of oil filter 60, with the lower surface of oil filter 60 engaging the top surfaces, such as 56, 58, of the radial ribs provided in the lower end of crushing chamber 42.

After placement of oil filter 60 within crushing chamber 42, the user then grasps door handle 36 and moves door 34 in a left-to-right direction, until door 34 attains its fully closed position, as shown in FIG. 1.

During left-to-right movement of door 34, ramped surface 166 of actuator member 162 engages roller 128 provided on movable valve stem 126 of air valve 118. When door 34 is moved to its fully closed position, roller 128 is moved to its full-up position, and is engaged within depression 170 formed in actuator surface 168 of actuator member 162. When valve stem 126 is in its full-up position, pressurized air from the external source is supplied from air valve 118 to external air hose 132, relief valve 140 and conduit 138 to the upper portion of piston chamber 40 above the upper surface of piston head 76. This initiates a downward, or crushing, stroke of piston assembly 74, resulting in engagement of the upper surface of oil filter 60 by filter engaging member 86 provided at the lower end of piston rod 78. Continued downward movement of piston head 76 resulting from introduction of pressurized air into piston chamber 40 above piston head 76 results in crushing of oil filter 60, to expel from oil filter 60 any used oil which is contained within the pleated filter element within its interior. The oil expelled from oil filter 60 passes into the spaces between the radial ribs, such as 48, 50, supporting oil filter 60, and into discharge opening 64. A hose or the like is connectable to opening 64 for passing the expelled waste oil to a collection receptacle or the like.

During downward movement of piston assembly 74, the lower ends of guide rods 80, 82 extend into passages 150, 152 formed in door assembly slide portion 144. The flat surfaces provided on guide rods 80, 82 are located closely adjacent the flat surfaces, such as 154, of passages 150, 152, and prevent door 34 from being moved to its open position during the crushing stroke of piston assembly 74.

Upon continued downward movement of piston assembly 74, the ramped surfaces, such as 83, of guide rods 80, 82 engage the flat walls, such as 154, of passages 150, 152 formed in door slide portion 144. When this occurs, the circular upper portions of guide rods 80, 82 are engaged within the circular passages in the bosses, such as 108*a*, 108*b* of center plate assembly 44, to prevent rotation of piston assembly 74. Continued downward movement of piston assembly 74 results in the ramped surfaces, such as 83, provided on guide rods 80, 82 engaging the flat surfaces, such as 154, associated with passages 150, 152, and movement of door assembly 142 away from its closed position. The movement of door assembly 142 results in disengagement of roller 128 from actuator surface 168 of actuator member 162, along ramped surface 166 and out of engagement with actuator member 162 completely. When this occurs, valve stem 126 is forced downwardly so as to move valve 118 to its closed position, in which supply of pressurized air to piston chamber 40 is cut off.

FIG. 6 shows piston assembly 74 in its full-down position in which ramped surface 83 of guide rod 82 has engaged the wall forming the upper end of passage 152 and rotated door assembly 142 away from its closed position. FIG. 7 illustrates the position of roller 128 and movable valve stem 126 when roller 128 is disengaged from actuator member 162.

When piston assembly 74 is in its full-down position, oil filter 60 is crushed between filter engaging member 86 and the upper surfaces of the ribs, such as 48, 50 provided in the lower end of crushing chamber 42, with substantially all of the oil which was contained within oil filter 60 expelled therefrom to drain through opening 64.

When the supply of pressurized air to piston chamber 40 is cut off as described, springs 102, 104 act on piston head 76 to force it upwardly within piston chamber 40, resulting in a return stroke of piston assembly 74. During upward movement of piston assembly 74, filter engaging member 86 is drawn upwardly along with piston rod 78, in preparation for receiving another oil filter to be crushed. The air contained within piston chamber 40 is expelled therefrom through fitting 136, conduit 138, relief valve 140 and hose 132 to air valve 118, where such air is exhausted through an exhaust port associated with air valve 118.

As an alternative to the automatic shut-off arrangement as described the user can grasp door handle 36 and move door 34 slightly open, even during the crushing stroke of piston assembly 74. Such movement of door 34 is provided by clearance between guide rods 80, 82 and the arcuate end walls, such as 156, of openings 150, 152 of door slide portion 144. The slight manual opening of door 34 results in disengagement of actuator member 162 and roller 128 in a manner as described, to cut off the supply of pressurized air to piston head 76. Door 34 cannot, however, be opened an amount sufficient to allow a person's fingers to be inserted into crushing chamber 42. The manual shut-off accommodates situations in which an oil filter may not be crushed an amount sufficient to initiate the automatic shut-off arrangement.

When piston assembly 74 is in its full-up position, as shown in FIG. 2, the lower ends of guide rods 80, 82 are fully withdrawn from passages 150, 152 formed in slide portion 144 of door assembly 142, thus allowing door 34 to be moved to its open position to allow placement of an oil filter within crushing chamber 42 through opening 32. After another oil filter has been placed within crushing chamber 42, the above-described steps are repeated to perform the crushing operation.

In normal circumstances, the air pressure supplied to air valve 118 from the external source is on the order of 80 psi. Pressure relief valve 140 may representatively provide relief for air pressure exceeding 110 psi to prevent damage to the components of crusher 10.

Various alternatives and embodiments are contemplated as being within the scope of the following claims particularly pointing out and distinctly claiming the subject matter regarded as the invention.

We claim:

1. An oil filter crusher comprising:

a housing defining an internal cavity including a crushing chamber adapted to receive an oil filter, wherein the housing includes a wall in which an opening is formed for providing access to the crushing chamber;

a door mounted to the housing for sliding movement over the opening along the wall, the door being movable between an open position for providing access to the crushing cavity through the opening to allow placement of an oil filter therein, and a closed position to block access through the opening to the crushing chamber;

a piston slidably movable within the cavity, the piston having a head and a rod, with structure being provided at the end of the rod opposite the head for engaging the oil filter, wherein movement of the piston in a first direction provides a crushing stroke and movement of the piston in a second direction provides a return stroke;

a selectively actuable pressurized fluid supply system for supplying pressurized fluid to the piston head to move the piston in the first direction to provide the crushing stroke, including a valve located within the internal cavity for controlling the supply of pressurized fluid from an external source of pressurized fluid to the piston head;

an actuator arrangement interposed between the door and the pressurized fluid supply system, wherein sliding movement of the door to its closed position actuates the valve to supply pressurized fluid to the piston and to thereby initiate the crushing stroke;

wherein the valve is provided with a movable stem for controlling the flow of pressurized fluid therethrough, and wherein an actuator member is mounted to the door for engaging the movable stem of the valve upon movement of the door to its closed position; and wherein a plate number is mounted to the housing and is located within the internal cavity, the plate member defining an end wall of the crushing chamber, and wherein the door is mounted to the plate member for revolving movement about an axis coincident with the longitudinal axis of the piston rod, between its open and closed positions.

2. The oil filter crusher of claim 1, wherein the door includes a transverse first portion movably mounted to the plate member for providing movement of the door between its open and closed positions, and a second portion for enclosing the opening in the housing when the door is in its closed position and movable out of the opening when the door is in its open position.

3. The oil filter crusher of claim 2, wherein the actuator member is mounted to the transverse portion of the door, and wherein the valve stem is located adjacent thereto, wherein movement of the door to its closed position causes engagement of the actuator member with the valve stem.

4. The oil filter crusher of claim 3, wherein the actuator member includes a ramped surface for engaging the valve stem.

5. The oil filter crusher of claim 4, wherein the valve stem is provided with a roller for riding on the ramped surface during movement of the door to its closed position.

6. The oil filter crusher of claim 1, further comprising a shut-off arrangement for disengaging the actuator member from the valve stem upon completion of the crushing stroke of the piston.

7. An oil filter crusher comprising:

a housing defining an internal cavity including a crushing chamber adapted to receive an oil filter, wherein the housing includes an opening providing access to the crushing chamber;

a door movably mounted to the housing at the opening for movement between an open position for providing access to the crushing cavity through the opening to allow placement of an oil filter therein, and a closed position to block access through the opening to the crushing chamber, wherein the door includes an actuator member;

a piston slidably movable within the cavity, the piston having a head and a rod and including structure provided at the end of the rod opposite the head for engaging the oil filter, wherein movement of the piston in a first direction provides a crushing stroke and movement of the piston in a second direction provides a return stroke;

a selectively actuable pressurized fluid supply system including a valve located within the internal cavity, the valve having a movable stem for controlling the supply of pressurized fluid to the piston head from an external source of pressurized fluid, to move the piston in the first direction to provide the crushing stroke;

wherein movement of the door to its closed position actuates the valve by the actuator member engaging the movable valve stem upon movement of the door to its closed position, to supply pressurized fluid to the piston and to thereby initiate the crushing stroke; and a shut-off arrangement for disengaging the actuator member from the valve stem upon completion of the crushing stroke of the piston, comprising structure provided on the piston for moving the door an amount sufficient to disengage the actuator from the valve stem when the piston reaches a predetermined position during its movement in the first direction, to terminate the crushing stroke.

8. An oil filter crusher comprising:

a housing defining an internal cavity including a crushing chamber adapted to receive an oil filter, wherein the housing includes an opening providing access to the crushing chamber;

a door movably mounted to the housing at the opening for movement between an open position for providing access to the crushing cavity through the opening to allow placement of an oil filter therein, and a closed position to block access through the opening to the crushing chamber;

a reciprocable member located within the cavity, wherein movement of the reciprocable member in a first direction provides a crushing stroke and movement of the reciprocable member in a second direction provides a return stroke;

a locking arrangement for preventing movement of the door to its open position during the crushing stroke of the reciprocable member, comprising locking structure provided on the reciprocable member engageable with locking structure provided on the door during movement of the reciprocable member in the first direction during the crushing stroke, to prevent movement of the door to its open position;

wherein the door includes a transverse portion disposed within the housing cavity, and wherein the locking structure provided on the door is provided on the transverse portion; and wherein the reciprocable member comprises a piston member having a head and a rod, and wherein the locking structure provided on the door comprises a passage extending through the transverse portion of the door, and wherein the locking structure provided on the reciprocable member comprises at least one guide rod mounted to the piston member which extends into and through the passage in the transverse portion of the door during movement of the piston member in the first direction during the crushing stroke.

9. The oil filter crusher of claim 8, wherein the at least one guide rod is connected to the piston head and extends parallel to the piston rod.

10. The oil filter crusher of claim 8, further comprising a second passage formed in the transverse portion of the door, and wherein the at least one guide rod comprises a pair of guide rods mounted to the piston member, wherein each guide rod extends into and through one of the passages during the crushing stroke of the piston member.

11. The oil filter crusher of claim 8, further comprising a selectively actuable pressurized fluid supply system for selectively supplying pressurized fluid to the piston head from a pressurized fluid source, and an actuator arrangement interposed between the door and the pressurized fluid supply system for supplying pressurized fluid to the piston head upon movement of the door to its closed position, and further comprising structure provided on the at least one guide rod for engagement with the transverse portion of the door to move the door away from its closed position upon attainment of a predetermined position of the piston member during its movement in the first direction, to cause the actuator arrangement to cut off the supply of pressurized fluid to the piston head and to thereby terminate the crushing stroke.

12. An oil filter crusher comprising:

a housing defining an internal cavity including a crushing chamber adapted to receive an oil filter, wherein the housing includes an opening providing access to the crushing chamber;

a door movably mounted to the housing at the opening for movement between an open position for providing access to the crushing cavity through the opening to allow placement of an oil filter therein, a fully closed position to block access through the opening to the crushing chamber, and a partially closed position in which the opening is partially exposed and access through the opening to the crushing chamber is substantially blocked;

a reciprocable member located within the cavity, wherein movement of the reciprocable member in a first direction provides a crushing stroke and movement of the reciprocable member in a second direction provides a return stroke;

a selectively actuable pressurized fluid supply system for supplying pressurized fluid to the reciprocable member to move the member in the first direction to provide the crushing stroke;

an actuator arrangement interposed between the door and the pressurized fluid supply system for actuating the pressurized fluid supply system upon movement of the door to its fully closed position to supply pressurized fluid to the reciprocable member and to thereby initiate the crushing stroke; and a shut-off arrangement interposed between the pressurized fluid supply system and the reciprocable member for cutting off the supply of pressurized fluid to the reciprocable member upon attainment of a predetermined position of the reciprocable member during its movement in the first direction, comprising structure provided on the reciprocable member for moving the door away from its fully closed position to its partially closed position upon attainment of a predetermined position of the reciprocable member during its movement in the first direction, to cut off the supply of pressurized fluid to the reciprocable member and to thereby terminate the crushing stroke.

13. An oil filter crusher comprising:

a housing defining an internal cavity including a crushing chamber adapted to receive an oil filter, wherein the housing includes an opening providing access to the crushing chamber;

a door movably mounted to the housing at the opening for movement between an open position for providing access to the crushing cavity through the opening to allow placement of an oil filter therein, and a closed position to block access through the opening to the crushing chamber, the door including a transverse portion disposed within the internal cavity;

a reciprocable member located within the cavity, wherein movement of the reciprocable member in a first direction provides a crushing stroke and movement of the reciprocable member in a second direction provides a return stroke;

a selectively actuable pressurized fluid supply system for supplying pressurized fluid to the reciprocable member to move the member in the first direction to provide the crushing stroke;

an actuator arrangement interposed between the door and the pressurized fluid supply system for actuating the pressurized fluid supply system upon movement of the door to its closed position to supply pressurized fluid to the reciprocable member and to thereby initiate the crushing stroke; and a shut-off arrangement interposed between the pressurized fluid supply system and the reciprocable member for cutting off the supply of pressurized fluid to the reciprocable member upon attainment of predetermined position of the reciprocable member during its movement in the first direction, the shut-off arrangement comprising structure provided on the reciprocable member for engaging the transverse portion of the door to move the door away from its closed position upon attainment of a predetermined position of the reciprocable member during its movement in the first direction, to cut off the supply of pressurized fluid to the reciprocable member and to thereby terminate the crushing stroke.

14. The oil filter crusher of claim 13, wherein the reciprocable member has a rod mounted thereto having a ramped surface disposed thereon for engaging the transverse portion of the door upon attainment of the predetermined position of the reciprocable member to move the door away from its closed position.

15. The oil filter crusher of claim 14, wherein the transverse portion of the door includes a passage, and wherein the rod mounted to the reciprocable member includes a portion extending into and through the passage during movement of the reciprocable member in the first direction, to prevent the door from being moved to its open position during the crushing stroke of the reciprocable member.

* * * * *